United States Patent [19]

Heinemans

[11] 4,445,282

[45] May 1, 1984

[54] COOLER FOR GRANULAR PRODUCTS

[76] Inventor: Henricus T. J. M. Heinemans, Narcisstraat 11, 6014 AK Ittervoort, Netherlands

[21] Appl. No.: 313,243

[22] Filed: Oct. 21, 1981

[30] Foreign Application Priority Data

Oct. 7, 1981 [DE] Fed. Rep. of Germany ..... 3139773

[51] Int. Cl.[3] ..... F26B 17/14

[52] U.S. Cl. ..... 34/168; 34/172; 222/561; 414/287; 414/288

[58] Field of Search ..... 222/547, 559, 561; 414/288, 304, 325, 209, 287; 34/168, 169, 170, 20, 56, 172

[56] References Cited

U.S. PATENT DOCUMENTS

| | | | |
|---|---|---|---|
| 2,148,946 | 2/1939 | Hubmann et al. | 34/168 |
| 3,112,188 | 11/1963 | Zehnder | 34/169 |
| 3,833,137 | 9/1974 | Mathews | 34/168 |

*Primary Examiner*—Larry I. Schwartz

*Attorney, Agent, or Firm*—Bernard, Rothwell & Brown

[57] ABSTRACT

The invention relates to a cooler for granular products, essentially consisting of a cooling reservoir, a product inlet at the top, and two grids for the discharge of granules, which grids are movable relatively to each other. In the cooling reservoir a current of air is generated by means of a blower, the cooling air being drawn in through the granule discharge grid and being passed through the cooling reservoir countercurrently relatively to the product to be cooled. The air inlet for the blower is disposed in the top part of the cooling reservoir adjacent to the granule inlet lock. Any fines present in the granular product are exhaused direct by the blower. For this purpose a controllable opening is provided in the suction tube of the blower for drawing in secondary air. The product discharge grid is of such construction that in the closed condition it is permeable to air without permitting the product to be cooled to flow out of the cooling reservoir.

5 Claims, 4 Drawing Figures

FIG. 2
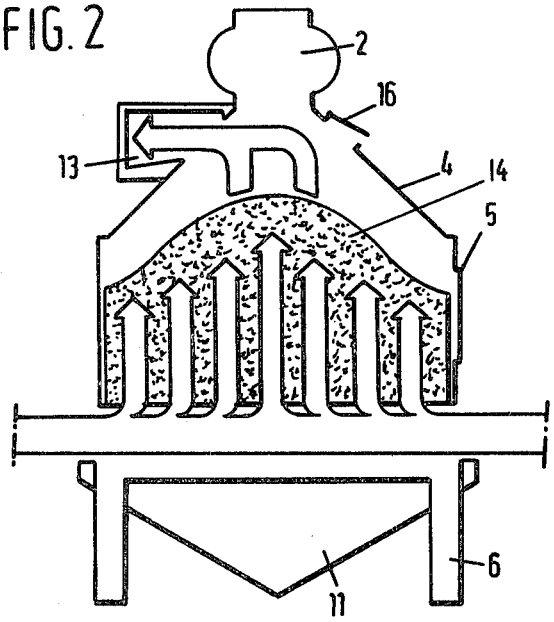
FIG. 3
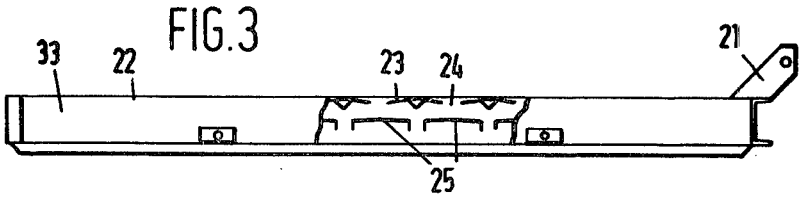
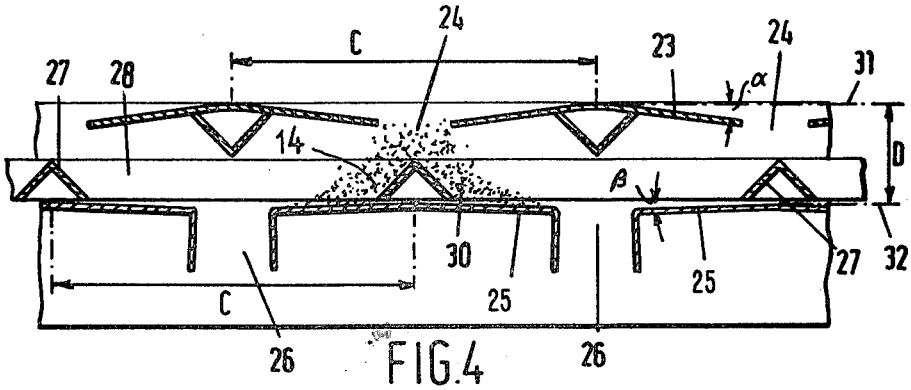
FIG. 4

COOLER FOR GRANULAR PRODUCTS

This invention relates to a cooler for granular products, comprising a cooling reservoir, being at the same time a storage hopper, a product inlet arranged at the top, a pair of grids for the discharge of granules, said grids being movable relatively to each other, and a blower for generating air flow.

French Pat. No. 578,235 discloses a similar apparatus, which is used for drying granular products. The hot air issuing from the blower is supplied to the bottom of the grid for the discharge of granules, and disappears via the top of the drying reservoir. The upper one of the two grids for the discharge of granules is a fixed grid, and a second, horizontally movable grid is arranged at the bottom side thereof. In the event of arching above or within the top discharge grid, there is a non-uniform product discharge from the apparatus.

It is an object of the present invention to render such an apparatus suitable for use as a cooler, while avoiding the above disadvantages.

For this purpose, the apparatus according to the invention is characterized in that the air inlet for the blower terminates in the top part of the cooling reservoir in the vicinity of the product inlet, which takes the form of a granule inlet lock, the arrangement being such that the cooling air is drawn in through the granule discharge grid, and flows in a direction opposite to the direction of movement of the mass of granules in the reservoir, while dust ment particles in the mass of granules are directly exhausted by the blower.

The advantage obtained in this manner is that the cooler can also operate as an air sieve, and can directly exhaust the fines from the product supplied. In the air inlet for the blower, an adjustable opening may be provided for the supply of secondary air, whereby the sieve action can be intensified or reduced to suit requirements.

Cooling a granular mass in a reservoir using the counter-current principle gives a large number of advantages. Thus, for example, the temperature difference between the product to be cooled and the cooling air taken in is relatively small throughout the entire cooling path. Any shrinkage of the granules will accordingly take place gradually, so that a temperature shock, as may occur in cross-current and concurrent systems, is avoided. This in turn has the advantage of minimizing cracking and the formation of fines in the product to be cooled. In addition, the use of the counter-current principle reduces air consumption and hence power consumption, while owing to the relatively high final temperature of the spent air, which is approximately 50°-60° C., the heat contained in it may be recovered, and moreover the formation of condensate in the installation and in the piping connected to it is avoided.

When the movable granule discharge grid is formed as a double grid, of which one grid surface is located above, and the other below the static grid, a certain stirring action is generated at the bottom of the granular mass in the reservoir, by virtue of which arching at the granule discharge grids is avoided, and accordingly a uniform and, in addition, properly controllable product outflow can be ensured. Variations in residence time can thus be avoided, and this in turn contributes towards uniform cooling.

One embodiment of the apparatus according to the invention will be described, by way of example, with reference to the accompanying drawings. In said drawings:

FIG. 2 is a diagrammatic longitudinal sectional view of the cooler;

FIG. 3 is a front elevational view of the movable grid; and

FIG. 4 shows a detail of the grid construction.

Figure 1:
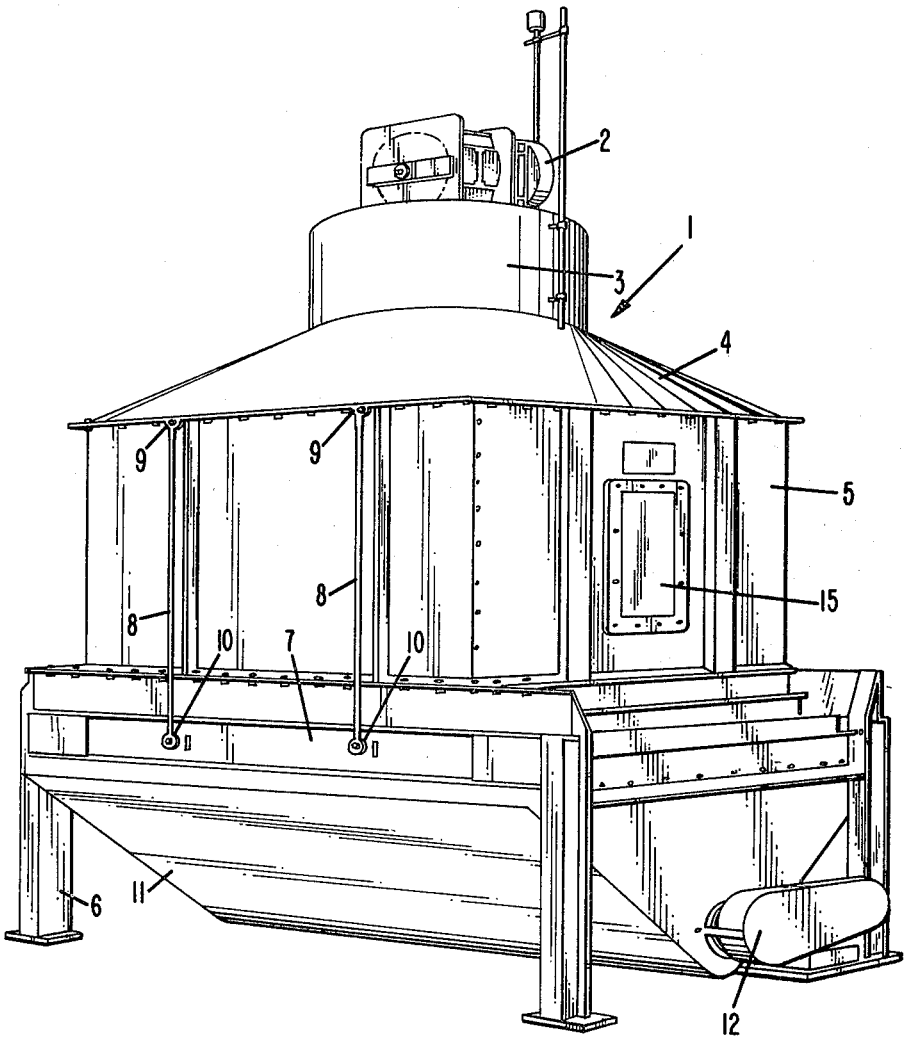
FIG. 1 is an elevational view of a counter-current cooler according to the present invention.

The cooler 1 as shown in FIG. 1 comprises an inlet lock 2 provided at the top, and by means of which, on the one hand, the amount of product flowing into the apparatus can be controlled, and, on the other hand, it is ensured that the interior of the cooling space is hermetically sealed. Disposed under inlet lock 2 is a connecting cylinder 3, in which terminates the air inlet of a blower not shown. The actual cooling reservoir, which at the same time is a storage hopper, consists of a rectangular or square space built up from steel sheeting, and provided with a window 15, the cooling reservoir 5 being supported on a frame 6, which at the bottom is provided with an outlet hopper 11. Provided at the bottom of outlet hopper 11 is a screw conveyor rotated by a drive 12 for discharging product contained in hopper 11. Provided at the bottom of cooling reservoir 5 is a discharge grid 7, which by means of reciprocating arms 8 is suspended for movement in the horizontal direction in suspension points 9. The points of attachment of reciprocating arms 8 to outlet grid 7 are shown at 10. Provided between connecting cylinder 3 and cooling reservoir 5 is a transition cone 4.

In the diagrammatic longitudinal sectional view of FIG. 2, the air current within cooling reservoir 5 is indicated by arrows. Owing to the fact that the outlet grid occupies the entire bottom of the cooling reservoir, the cooling air can be drawn in throughout the entire bottom surface area of cooling reservoir 5. The granular mass 14 contained in this reservoir is uniformly cooled, the air being exhausted through intake conduit 13 of the blower not shown. An opening of controllable diameter for allowing the passage of secondary air is provided at 16, so that a larger or smaller stream of air in the transverse direction can be generated just under product inlet lock 2 for the exhaust of dust and fines carried along with the granular mass through inlet lock 2.

The outlet grid 7 is shown in FIGS. 3 and 4. This grid consists of a double grid 22, built up from a frame 33 in which two grids are mounted to provide separate grid surfaces 31, 32, spaced apart a distance D (see FIG. 4). The upper grid 31 is built up from longitudinal elements 23, each pair of successive elements 23 being separated by a material outlet slot 24. Elements 23 are preferably offset downwardly through a small angle $\alpha$ about their longitudinal centre line, angle $\alpha$ ranging from 5° to 10°. The bottom grid surface 32 is built up from elongated elements 25 with slots 26 between each pair of successive elements 25. The pitch distance of elements 23 and of elements 25 equals C, with elements 25 being offset relatively to elements 23 by a half pitch distance, so that elements 25 are located right under the material outlet slots 24 of the top grid. Elements 25 of the bottom grid surface are also preferably deflected downwardly through a small angle $\beta$ to make possible the reciprocating movement of the double grid 22 relative to elements 27 of the stationary grid 28. In FIG. 4, three elements 27 of the stationary grid 28 are shown, which elements 27 are arranged at a mutual pitch distance C in the stationary grid similar to the pitch distance of elements 23 and 25. The condition shown in the figure is a stationary condition, with the bulk material 30 issuing from the material outlet slots 24 coming to rest as a conical body on elements 25 of the bottom grid surface. When the movable grid 22 is moved, for example to the right (see FIG. 4) elements 23 and 25 move relatively to the stationary elements 27 of the stationary grid. The conical bodies of bulk material resting on elements 25 are accordingly shifted by these elements 27 from a supporting surface 25 and through slots 26 enter a hopper 11 mounted in frame 6, whence the bulk material 30 can be removed by means of a screw conveyor. During this movement to the right, a new conical body of bulk material is built up at the other side of each element 27 of the stationary grid 28, which is moved off its supporting surface 25 upon the return movement of the movable grid 22.

It will be clear that the distance D between the grid surfaces 31, 32 formed by elements 23, 25, respectively, the width of elements 23, 25 and that of the material outlet slots 24, 26 are interrelated. An increase of distance D has for its result that the base of the conical body of bulk material becomes broader, and this in turn must necessarily lead to a broadening of element 25. Good practical results have been obtained with a distance D between the grid surfaces of approximately 50 mm, elements 23, 25 with a width of approximately 160 mm, and material outlet slots 24, 26 of approximately 40 mm. The total structural height of the double grid is no more than 120 mm.

I claim:

1. A cooler for granular products, especially feed pellets and the like, including a mass of granules and fines, the mass of granules moving between a product inlet and a product outlet, comprising a cooling reservoir, at the same time being a storage hopper, a discharge grid for the discharge of the mass of granules, said discharge grid including a stationary grid and a movable grid, and a blower for generating an air current, characterized in that said movable grid is disposed above said stationary grid, and the air inlet (13) for the blower terminates in the top part of the cooling reservoir (5) adjacent the product inlet, which is formed as a granule inlet lock (2), the arrangement being such that the cooling air is drawn in through the discharge grid (7) and flows in a direction opposite to the direction of movement of the mass of granules (14) in the reservoir (5), the fines in the incoming mass of granules being directly exhausted by the blower, said movable grid (22) is of double construction and consists of two virtually parallel, spaced grid surfaces (31,32) built up from substantially horizontally extending elements (23,25) spaced uniform distances (24,26) apart, the elements (23) of the first grid surface (31) being offset by half the pitch distance (C) relatively to the elements (25) of the second grid surface (32), the distance (D) between the grid surfaces, the interspaces (24,26) between, and the width of elements (23,25) being so selected that the material discharged through openings (24) in the first grid surface (31) from the reservoir can keep lying on the elements (25) of the second grid surface (32), said stationary grid being disposed between the two grid surfaces of said movable grid (22) and comprising elements (27) extending vertically to said grid surfaces (31,32), the pitch distance (C) of said elements (27) being equal to the pitch distance of said substantially horizontally extending elements (23,25) of said double grid (22).

2. Apparatus as claimed in claim 1, characterized in that said double grid (22) is suspended from reciprocating arms (8) there being provided a drive mechanism for moving said double grid (22) in the main plane thereof relatively to said stationary grid (28).

3. Apparatus as claimed in claim 1 or 2, characterized in that the elements (27) of said stationary grid (28) include two legs forming an apex which, as viewed in cross-section, is located in the vertical median plane of the material outlet slots (24) of the top grid surface (31) of said movable grid (22) when said movable grid (22) is in its central position, with the ends of the two legs of each element (27) being located adjacent to the bottom grid surface (32) of said double movable grid (22).

4. Apparatus as claimed in claim 1 or 2, characterized in that the elements (23) of the top grid surface (31) of the double said movable grid are deflected downwardly through a small angle ($\alpha$) about their longitudinal centreline to avoid arching in the reservoir.

5. Apparatus as claimed in claim 1 or 2, characterized in that the elements (25) of the bottom grid surface (32) of said movable grid are deflected downwardly about their longitudinal centreline through a small angle ($\beta$) in such a manner that during the reciprocating movement of said movable grid (22) this grid is not blocked by said stationary grid (28).

* * * * *

UNITED STATES PATENT AND TRADEMARK OFFICE

CERTIFICATE OF CORRECTION

PATENT NO. : 4,445,282

DATED : May 1, 1984

INVENTOR(S) : Henricus T.J.M. Heinemanns

It is certified that error appears in the above-identified patent and that said Letters Patent is hereby corrected as shown below:

Column 1, line 31, delete "ment".

Column 4, line 35, delete the word "double".

Column 4, line 38, delete the words "the double".

Signed and Sealed this

*Eighteenth* Day of *September 1984*

[SEAL]

*Attest:*

GERALD J. MOSSINGHOFF

*Attesting Officer*

*Commissioner of Patents and Trademarks*